US005862617A

United States Patent [19]

Alvern

[11] Patent Number: 5,862,617

[45] Date of Patent: Jan. 26, 1999

[54] DISPLAY APPARATUS

[75] Inventor: Stein Alvern, Oslo, Norway

[73] Assignee: Alvern-Norway A/S, Norway

[21] Appl. No.: 723,907

[22] Filed: Sep. 30, 1996

[51] Int. Cl.[6] ..... B61D 5/00

[52] U.S. Cl. ..... 40/661.12; 222/23; 141/392; 141/98

[58] Field of Search ..... 141/98, 390, 391, 141/392; 222/23, 173; 40/661, 299, 661.12

[56] References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| D. 279,484 | 7/1985 | Goldman . | |
| D. 366,310 | 1/1996 | Fell . | |
| 608,596 | 8/1898 | Harrington | 141/392 |
| 4,408,791 | 10/1983 | Griffin et al. . | |
| 4,465,209 | 8/1984 | Wilder . | |
| 4,690,182 | 9/1987 | Knaus . | |
| 5,058,367 | 10/1991 | Fell . | |
| 5,184,309 | 2/1993 | Simpson et al. . | |
| 5,184,655 | 2/1993 | Fell . | |
| 5,538,135 | 7/1996 | Hexter, Jr. | 40/779 |

FOREIGN PATENT DOCUMENTS

| | | |
|---|---|---|
| S-122642 | 2/1995 | Australia . |
| S-123343 | 5/1995 | Australia . |
| 0407271A1 | 1/1991 | European Pat. Off. . |
| 62-208396 | 9/1987 | Japan . |
| 850627 | 10/1992 | Japan . |
| 1393062 | 5/1975 | United Kingdom . |
| 1473828 | 5/1977 | United Kingdom . |
| 2147273 | 5/1985 | United Kingdom . |
| WO90/08375 | 7/1990 | WIPO . |
| WO9315493 A1 | 8/1993 | WIPO . |
| WO9727141 A1 | 7/1997 | WIPO . |

*Primary Examiner*—Cassandra H. Davis

*Attorney, Agent, or Firm*—Finnegan, Henderson, Farabow, Garrett & Dunner, L.L.P.

[57] ABSTRACT

A display apparatus removably attachable to a fuel pump filler gun. A display carrying body configured, when fitted onto the filler gun, to cover an upper part of a gun head of the filler gun, a pair of side panels extending down from the carrying body on either side thereof to lie along either side of the gun head, respectively, when the carrying body is fitted onto the filler gun, a display card support provided on an upper face of the display carrying body, and the side panels having gripping structure for use when attaching the display apparatus to the filler gun.

10 Claims, 3 Drawing Sheets

DISPLAY APPARATUS

BACKGROUND OF THE INVENTION

1. Field of the Invention

The present invention relates to a display apparatus removably attachable to a fuel pump filler gun, the filler gun including in sequence a gun barrel, a gun head, and a gun handle, the barrel joining the gun head at a first junction, and the gun handle joining the gun head at a second junction.

2. Description of the Related Art

Such a display apparatus is e.g. described in the co-pending U.S. patent applications Ser. No. 08/284427, 08/590407, 08/610961 and continuation-in-part application of the latter, filed 3rd Jul. 1996.

SUMMARY OF THE INVENTION

The present invention aims at providing simple means for attaching a display carrying body onto a filler gun, and in particular such a type of filler gun, wherein other standard means for attaching the display carrying body onto the filler gun do not fit.

According to the present invention, the display apparatus comprises a display carrying body configured, when fitted onto the filler gun to cover an upper part of the gun head, a pair of side panels extending down from said carrying body on either side thereof to extend down along either side of said gun head, respectively, when said carrying body is fitted onto the filler gun, a display card support provided on an upper face of said display carrying body, and said side panels having grip means for use when attaching said display apparatus to the filler gun.

According to an embodiment of the present display apparatus, a top member is releasable attachable to said carrying body to hold at least a part of a display message card located on said display support. In a preferred embodiment, said side panels are integral with said carrying body. However, in an alternative embodiment, said side panels are releasably attached to said carrying body, suitably by snap-lock means.

Said grip means are, according to a preferred embodiment of the invention, through holes in said side panels and through which straps can pass to let the straps for attachment of the carrying body to the filler gun extend over a lower part of the gun head from one side panel to the other. When said carrying body is to be attached to the filler gun, the straps are made to extend through holes in said side panels and further to extend over a lower region of the gun head from one side panel to the other. Suitably, said side panels are curved at a lower part thereof, and said holes are equally spaced apart along said curved lower part. Preferably, said holes are spaced apart by an angle selected from the range 20–60 degrees.

BRIEF DESCRIPTION OF THE DRAWINGS

The invention is now to be described with reference to the attached drawings showing typical preferred embodiments of the present invention. However, it will be obvious to one of ordinary skill in the art that modifications of the display apparatus can be made without departing from the inventive concept as defined in the attached patent claims.

DESCRIPTION OF THE PREFERRED EMBODIMENTS

Figure 1:
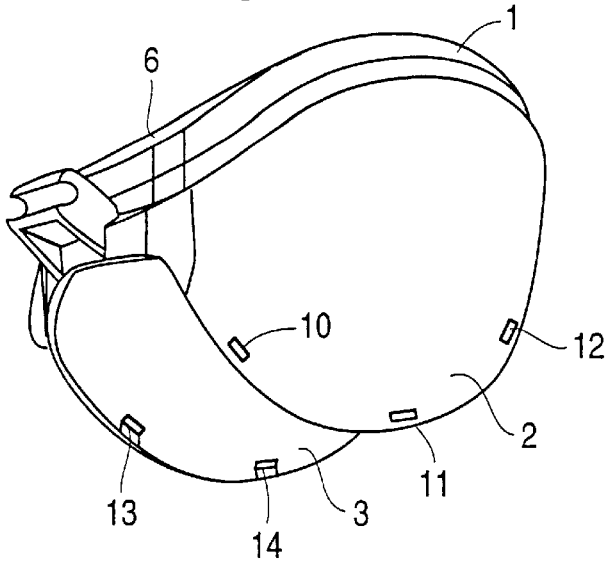
FIG. 1 shows a display apparatus with a display carrying body and side panels according to a first embodiment of the present invention.

In the embodiment of FIG. 1 the display apparatus comprises a display carrying body 1 which is integral with side panels 2, 3 configured to extend down from the carrying body in order that when fitted onto the fuel pump filler gun 4 over its gun head 5, the side panels 2, 3 will extend down from the carrying body 1 on either side of said gun head 5. The display carrying body has a display card support provided on an upper face 6 of said carrying body 1. Further, a top member 7 is releasably attachable to the carrying body 1, e.g. through a hinge connection 8 to be able to hold a least a part of a display message card 9 located on said upper face. The side panels 2,3 are provided with grip means 10, 11, 12, 13, 14 (of which only a few are shown in FIG. 1) for use when attaching the display apparatus to the filler gun. The grip means in the form of said holes 10–14 are through-holes in the side panels. One or more straps 15, 16, 17, suitably of self-locking type, pass through said holes 10–14 when attaching the display apparatus onto the filler gun, said straps extending over a lower region of the gun head from one side panel to the other, as clearly demonstrated in FIG. 2.

Figure 2:
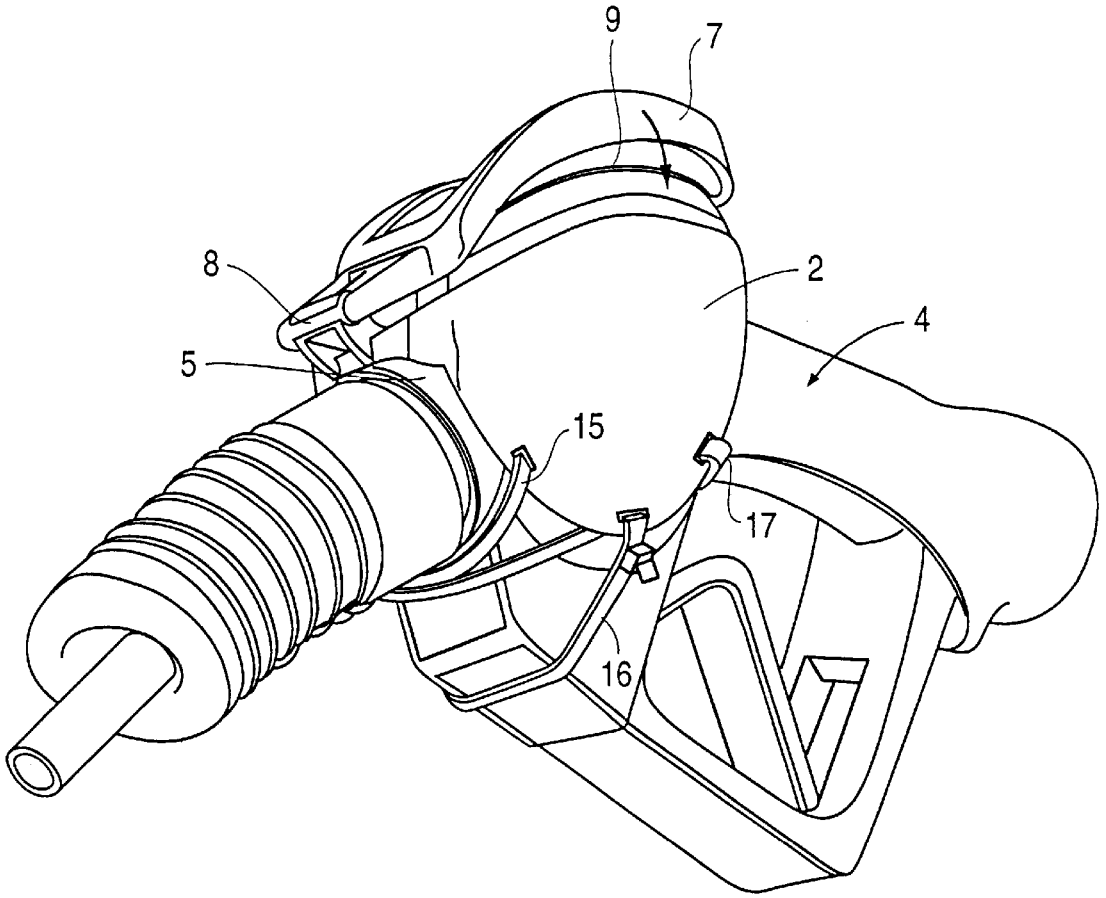
FIG. 2 shows the display apparatus according to FIG. 1 attached to a fuel pump filler gun.
Figure 3:
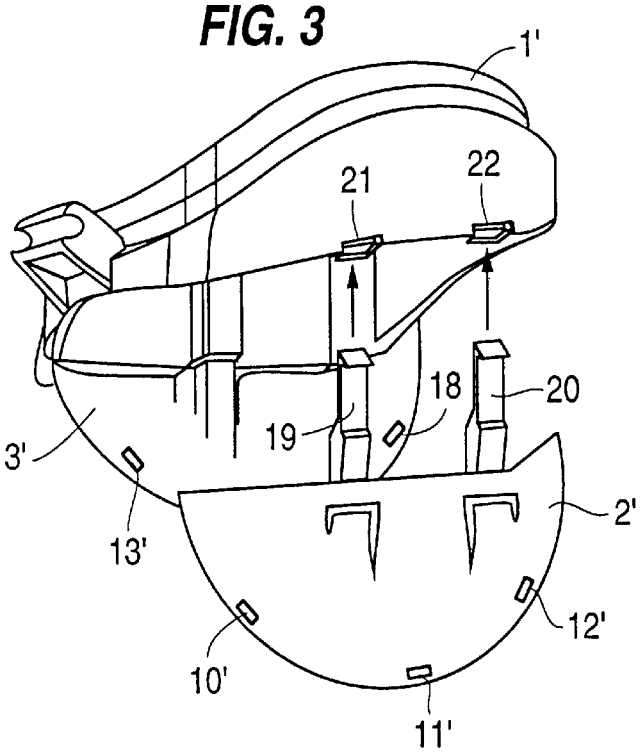
FIG. 3 shows a display apparatus with a display carrying body and releasably attachable side panels.

On FIG. 3, the display apparatus is shown in the form of its second preferred embodiment having a display carrying body 1' with side panels 2', 3' which are releasably attachable to the display carrying body 1' by means of male engagement members 19, 20 protruding up from said side panels and snap engageable with female snap-lock means 21, 22. Grip means in the form of holes 10', 11', 12', 13', 18 (not all holes being shown on FIG. 3) are used for attaching said straps 15, 16, 17 to the side panels, as just described in connection with FIG. 2.

Figure 8:
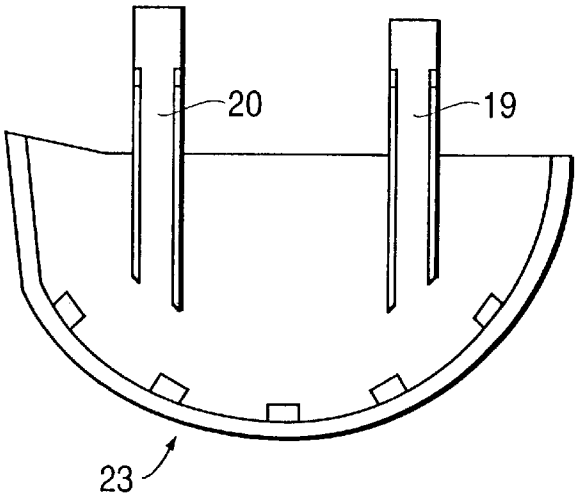

As will appear from FIGS. 5–8, as well as from FIGS. 1–4, the side panels are curved at a lower part thereof, as indicated by reference numeral 23 on FIG. 8. In the embodiment indicated on FIGS. 5–8, there are shown five through holes 24, 25, 26, 27 and 28 instead of only three holes as indicated on FIGS. 1–4. However, the number of holes could be any suitable number dependent on how the straps, e.g. straps 15, 16, 17 are to be attached to the side panels and the fuel pump filler gun 4. Thus, it is conceivable that e.g. only holes 24, 26 and 28 are used or perhaps only two of the holes in each side panel. In order to avoid incorrect positioning of side panels 2', 3', e.g. by switching the panels, the male snap engagement members 19, 20 should have a difference in length as denoted by $\Delta L$ on FIG. 7.

Figure 4:
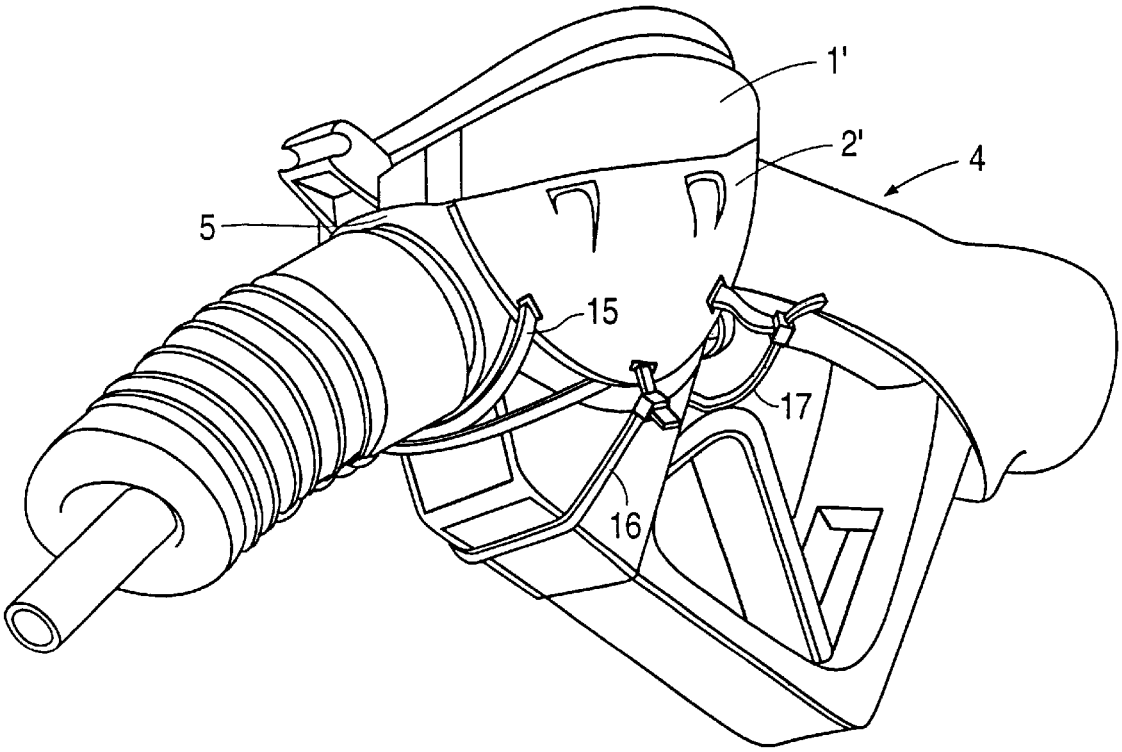
FIG. 4 shows the display apparatus according to FIG. 3 attached to a fuel pump filler gun.
Figure 5:
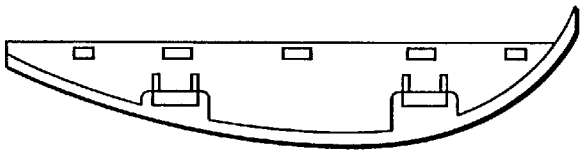
FIG. 5, 6, 7 and 8 are views from the top, the rear end, and the side seen from outside and the side seen from inside of said side panels in FIGS. 3 and 4.
Figure 7:
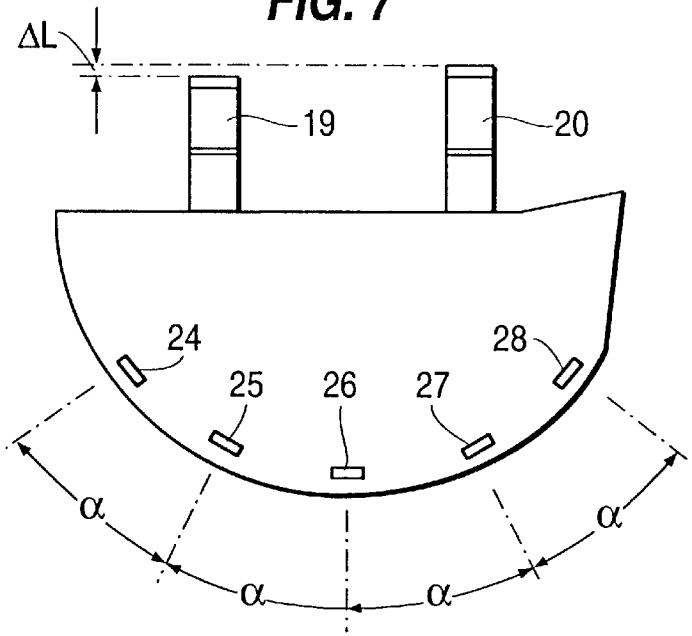
Figure 6:
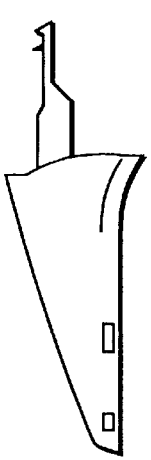

As noted from FIGS. 2 and 4, the display carrying body is suitably configured to extend from the first junction to the second junction as defined above, although that should not be construed as a limitation to the present invention.

Having described my invention, I claim:

1. A display apparatus removably attachable to a fluid pump filler gun, the filler gun including in sequence a gun barrel, a gun head, and a gun handle, the gun head including an upper portion, first and second side portions, and a lower portion, the display apparatus comprising:

a display carrying body configured, when fitted onto the filler gun, to cover the upper portion of the gun head:

first and second side panels extending down from said carrying body on either side thereof to lie along the first and second side portions of the gun head respectively, when said carrying body is fitted onto the filler gun, said first and second side panels defining an opening through which the lower portion of the filler gun projects:

a display card support provided on an upper face of said display carrying body;

a strap attachable to said first and second side panels and extendable beneath the lower portion of the gun head to hold the display apparatus on the gun head; and through holes provided in said first and second side panels through which ends of said strap can pass.

2. A display apparatus removably attachable to a fluid pump filler gun, the filler gun including in sequence a gun barrel, a gun head, and a gun handle, the gun head including an upper portion, first and second side portions, and a lower portion, the display apparatus comprising:

a display carrying body configured, when fitted onto the filler gun, to cover the upper portion of the gun head:

first and second side panels extending down from said carrying body on either side thereof to lie along the first and second side portions of the gun head respectively, when said carrying body is fitted onto the filler gun, said first and second side panels defining an opening through which the lower portion of the filler gun projects:

a display card support provided on an upper face of said display carrying body; and a plurality of straps attachable to a plurality of holes provided in said first and second side panels wherein each of said side panels includes an arcuate lower portion, and the plurality of holes are equally spaced apart along said arcuate lower portion for receiving ends of said straps.

3. A display apparatus removably attachable to a fluid pump filler gun, the filler gun including in sequence a gun barrel, a gun head, and a gun handle, the gun head including an upper portion, first and second side portions, and a lower portion, the display apparatus comprising:

a display carrying body configured, when fitted onto the filler gun, to substantially cover the upper portion of the gun head;

first and second side panels extending down from said carrying body on said first and second side portions of the gun head, respectively, when the display apparatus is fitted onto the filler gun, said first and second side panels including a means for gripping the gun head; and a display card and support provided on an upper face of said display carrying body;

wherein said side panels attach to said carrying body with snap-locks.

4. A display apparatus according to claim 1, 2, or 3 wherein a top member is releasably attachable to said carrying body to hold at least a part of a display message card located on said upper face.

5. A display apparatus according to claim 1 or 2, wherein said side panels are integral with said display carrying body.

6. A display apparatus according to claim 1, 2, or 3 wherein said side panels are releasably attached to said carrying body.

7. A display apparatus according to claim 1, 2 or 3, wherein said side panels are curved at least over a lower part thereof.

8. A display apparatus according to claim 2, wherein said holes are spaced apart by an angle selected in a range of 20–60 degrees.

9. A display apparatus according to claim 1, 2, or 3, further comprising a top member releasably attachable to said carrying body defining said display card support.

10. A display apparatus according to claim 9, further comprising a hinge for pivotally attaching said top member to said carrying body.

* * * * *